US006345606B1

(12) United States Patent
Ricci-Ottati et al.

(10) Patent No.: US 6,345,606 B1
(45) Date of Patent: Feb. 12, 2002

(54) METHOD FOR CONTROLLING FUEL RAIL PRESSURE USING A PIEZOELECTRIC ACTUATED FUEL INJECTOR

(75) Inventors: Giulio Angel Ricci-Ottati, Burton; Russell Harmon Bosch, Gaines, both of MI (US)

(73) Assignee: Delphi Technologies, Inc, Troy, MI (US)

( * ) Notice: Subject to any disclaimer, the term of this patent is extended or adjusted under 35 U.S.C. 154(b) by 0 days.

(21) Appl. No.: 09/548,223

(22) Filed: Apr. 12, 2000

(51) Int. Cl.[7] ..... F02M 37/04
(52) U.S. Cl. ..... 123/456; 123/467
(58) Field of Search ..... 123/446, 447, 123/456, 467

(56) References Cited

U.S. PATENT DOCUMENTS 4,426,981 A * 1/1984 Greiner et al. ..... 123/488
5,213,083 A * 5/1993 Glassey ..... 123/447
5,711,274 A * 1/1998 Drummer ..... 123/456
5,713,326 A * 2/1998 Huber ..... 123/447 X

* cited by examiner

*Primary Examiner*—Tony M. Argenbright
(74) *Attorney, Agent, or Firm*—John Van Ophem

(57) ABSTRACT

A fuel injection system is provided for controlling fuel pressure in a common rail through the use of a piezoelectric actuated fuel injector. The fuel injection system includes at least one fuel injector having an axially extending fuel passage therein, a control chamber disposed in the injector, an injector valve axially movable within the fuel passage in accordance with a fuel pressure in the control chamber, and a piezoelectric actuator for actuating the control valve. The fuel injection system further includes a pressure sensor for determining a fuel pressure in the common rail, and a controller electrically connected to the pressure sensor and to the piezoelectric actuator of the fuel injector.

6 Claims, 6 Drawing Sheets

METHOD FOR CONTROLLING FUEL RAIL PRESSURE USING A PIEZOELECTRIC ACTUATED FUEL INJECTOR

TECHNICAL FIELD

The present invention relates generally to a piezoelectric actuated fuel injector for use in conjunction with an internal combustion engine and, more particularly, to a method for controlling rail fuel pressure through the use of a piezoelectric actuated fuel injector.

BACKGROUND OF THE INVENTION

It is well known in the automotive engine art to provide solenoid actuated fuel injectors for controlling the injection of pressurized fuel into the cylinders of an internal combustion engine. Each fuel injector may include an injector body having an axially extending fuel passage therein, a control chamber disposed in the injector body, and an injector valve for controlling fuel flow from the injector. A solenoid actuated control valve may be used to control the fuel pressure in the control chamber, such that the injector valve is axially movable within the fuel passage in accordance with the fuel pressure in the control chamber.

Controlling fuel pressure in the common rail interconnecting the fuel injectors is a critical aspect of achieving accurate fuel injection. In one instance, the fuel injector may be used to relieve fuel pressure to a low pressure fuel return circuit. U.S. Pat. No. 5,711,274 discloses a known method for reducing fuel pressure, where a solenoid actuated control valve is quickly pulsed on/off in order to relieve fuel pressure without axially moving the injector valve within the injector body.

Piezoelectric devices are attractive candidates as control valve actuators in high pressure fuel injection systems. The precise longitudinal deflection characteristic of piezoelectric devices in conjunction with their rapid dynamic response provides the potential of achieving meaningful control over the rate of fuel injection. Additionally, the relative high load capability of piezoelectric devices is consistent with the extremely high pressure environment of common rail fuel injectors.

Therefore, it is desirable to provide a method for controlling fuel pressure in the common rail through the use of a piezoelectric actuated fuel injector. Since the movement of the control valve is proportional to the longitudinal growth of the piezoelectric device, the piezoelectric actuated fuel injector provides better control of the fuel pressure relieved through the low pressure return circuit. It is further desired to the use of the piezoelectric actuated fuel injector to compensate for pressure pulsations within the common rail of the fuel injection system.

SUMMARY OF THE INVENTION

In accordance with the present invention, a fuel injection system is provided for controlling fuel pressure in a common rail through the use of a piezoelectric actuated fuel injector. The fuel injection system includes at least one fuel injector having an axially extending fuel passage therein, a control chamber disposed in the injector, an injector valve axially movable within the fuel passage in accordance with a fuel pressure in the control chamber, a control valve for controlling fuel pressure in the control chamber, and a piezoelectric actuator for actuating the control valve. The fuel injection system further includes a pressure sensor for determining a rail pressure in the common rail, and a controller electrically connected to the pressure sensor and to the piezoelectric actuator of at least one fuel injector. In response to a signal from the pressure sensor, the controller actuates the control valve such that the control chamber relieves pressure through a low pressure fuel return circuit without axially moving the injector valve within the injector body, thereby controlling fuel pressure in the system.

For a more complete understanding of the invention, its objects and advantages, refer to the following specification and to the accompanying drawings.

DESCRIPTION OF THE PREFERRED EMBODIMENT

Figure 1:
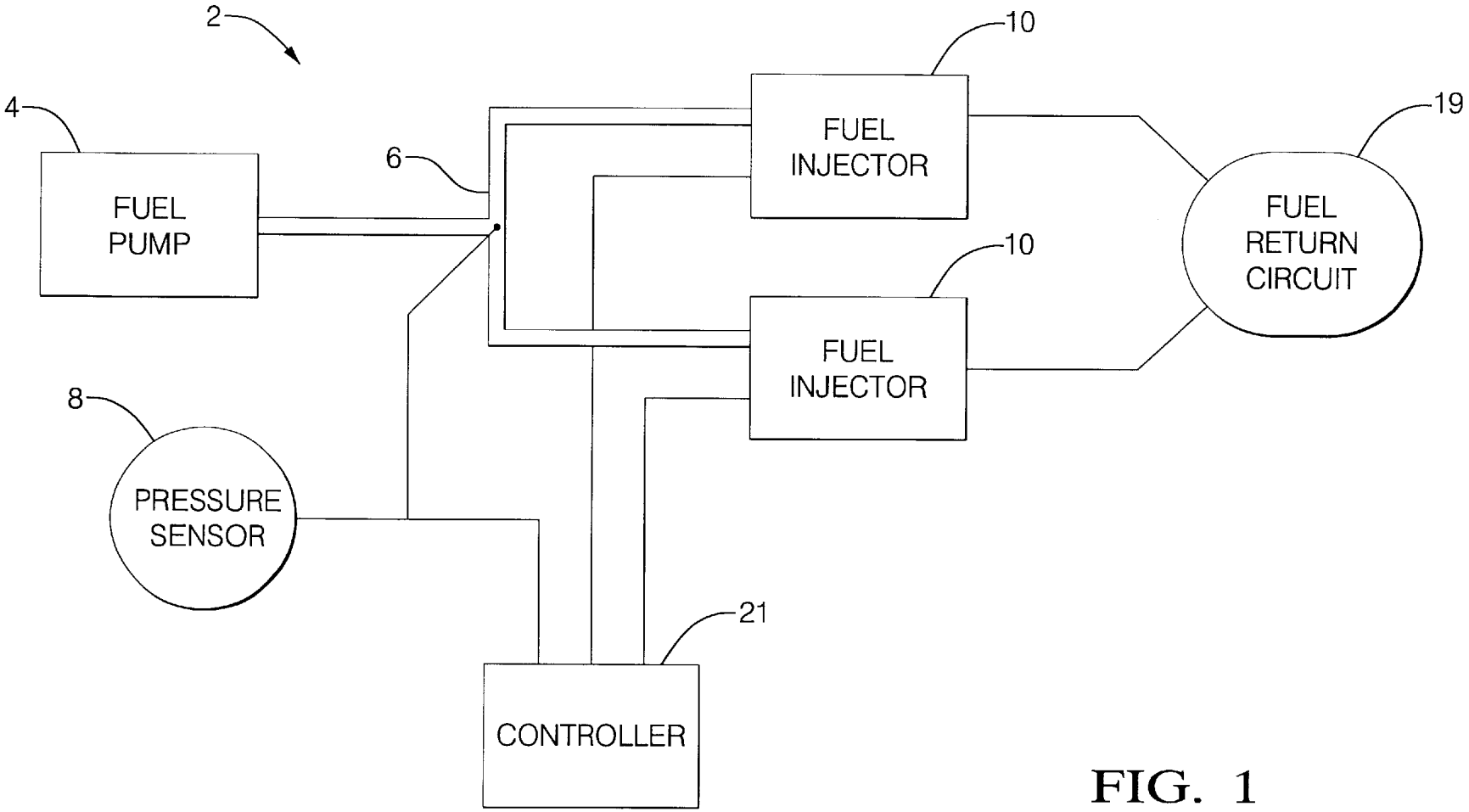
FIG. 1 is a block diagram depicting the basic components of a fuel injection system.

A fuel injection system 2 embodying features of the present invention is shown in FIG. 1. The fuel injection system 2 generally includes a fuel pump 4 for supplying pressurized fuel, at least two piezoelectric actuated fuel injectors 10 interconnected via a common rail 6 to the fuel pump 4, and a pressure sensor 8 for determining the fuel pressure in the common rail 6. As will be more fully explained below, it is envisioned that a piezoelectric device associated with one of the fuel injectors may also be used for determining the fuel pressure in the system.

Figure 2:
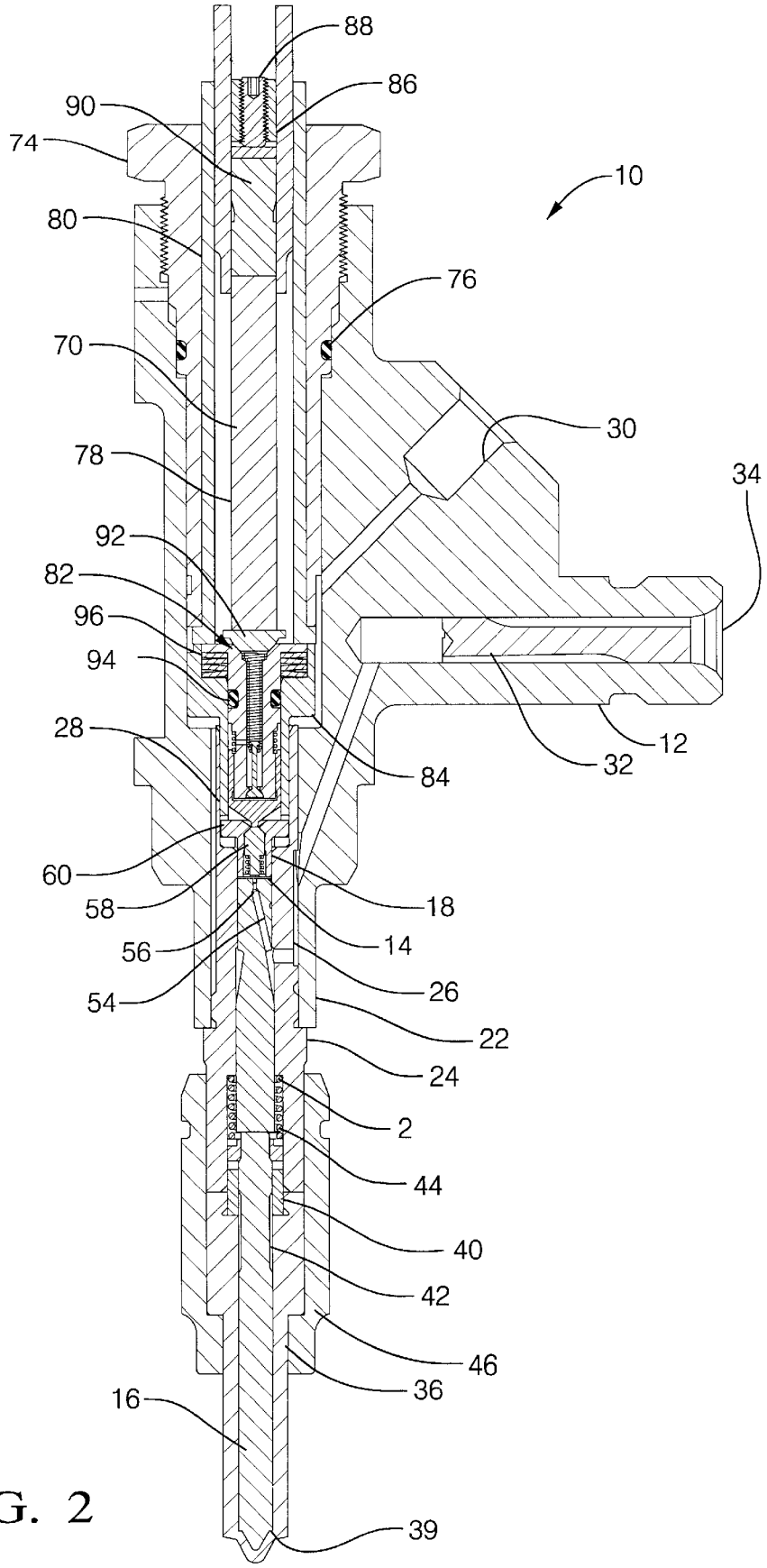
FIG. 2 is a cross-sectional view of an exemplary piezoelectric actuated fuel injector in accordance with the present invention.

Referring to FIG. 2, the fuel injector 10 includes an injector body 12 having an axially extending fuel passage therein, a control chamber 14 disposed within the injector body 12, an injector valve 16 axially movable within the fuel passage in accordance with the fuel pressure in the control chamber 14, a control valve assembly 18 for controlling fuel pressure in the control chamber 14, and a piezoelectric actuator 70 for actuating the control valve. In operation, the control valve assembly 18 selectively connects the control chamber 14 through an outlet port 30 to a low pressure fuel return circuit 19, thereby reducing the fuel pressure in the control chamber 14.

In accordance with the present invention, a controller 21 is electrically connected to the pressure sensor 8 and to the piezoelectric actuator 70 of at least one fuel injector 10. In response to a signal from the pressure sensor 8, the controller 21 actuates the control valve such that the control chamber 14 relieves pressure through the low pressure fuel return circuit 19 without axially moving the injector valve 16 within the injector body 12. In this way, the fuel injection system 2 of the present invention is able to control fuel pressure in the common rail without injecting fuel into the combustion chamber.

An exemplary piezoelectric actuated fuel injector 10 will be described in relation to FIG. 2. While the following description is provided with reference to a particular fuel injector, it is readily understood that the broader aspects of the present invention are applicable to other types of and/or configurations for the piezoelectric actuated fuel injector.

The injector body 12 is comprised of a body housing 22 and a body insert 24 that are joined by means of a thermally assisted diametral interference fit. The body insert 24 includes localized flats on the joining diameter that form individual passages 26 and 28 after assembly with the body housing 22. The individual passages 26 and 28 conduct pressurized fuel into the injector and unpressurized fuel back through an outlet port 30 to the fuel return circuit (not shown), respectively. The injector body 10 further includes a fuel filter 32 that is press fit into a fuel inlet port 34.

The needle-type injector valve 16 is diametrally mated at one end to the injector body and at the other end to a spray tip 36. A hollow dowel 40 may be used to assure adequate alignment of the spray tip 36 and the injector body 12. The spray tip 36 centrally guides the injector valve 16, thereby assuring a positive liquid seal between the sealing angle at the end of the injector valve 16 and the valve seat 38 of the spray tip 36. In addition, the mated fit between the injector valve 16 and the spray tip 36 further defines a calibrated restrictive fuel passage 42, such that fuel flows through the passage 42 when the injector valve 16 is axially separated from the valve seat 40. In order to prevent leakage of fuel into the combustion chamber, a spring 44 may also be installed between the injector valve 16 and the injector body 12. In this way, the injector valve 16 maintains sealing contact with the valve seat 38 when the fuel system is not pressurized and/or when fuel delivery is not required. To prevent external fuel leakage, a threaded nut 46 is used to hold the spray tip 36 in intimate contact with the injector body 12.

The control valve assembly 18 is installed into the injection body 12 at the end of the injector valve 16 opposite the valve seat 38. The control chamber 14 is bounded by the control valve assembly 18. In order to actuate the injector valve 16, the control chamber 14 is filled with a working fluid (e.g., the fuel for the engine) and placed in fluid communication with the injector valve 16. In this preferred embodiment, the working fluid is provided by a passageway 54 that leads from the fuel inlet port 34 through a control orifice 56 and discharges into the control chamber 14.

The control valve assembly 18 further includes an outwardly opening (i.e., against the direction of fuel flow) control valve 58 that is closely mated to a control valve seat 60. The control valve 58 is held in sealing position against the control valve seat 60 by the fuel pressure within the control chamber 14. When the fuel pressure is absent, the control valve 58 may be held in sealing position by a spring 62. It is envisioned that other elastic members may be suitable used in place of the spring. A calibrated spacer 64 is used to control the gap between the end of the control valve seat 60 and the injector 16, thereby establishing the stroke length for the injector valve 16. To prevent fuel leakage from the control chamber 14, the control valve assembly 18 is press fit into the mated diameter of the injector body 12.

A piezoelectric actuator 70 is used to actuate the control valve 58. The piezoelectric actuator 70 is positioned in the upper portion of the injector body 12. The piezoelectric actuator 70 is then securely affixed into the injector body 12 by way of a threaded cap 74. A seal ring 76 may also be provided between the threaded cap 74 and the injector body 12 to prevent fuel leakage.

The piezoelectric actuator 70 is generally comprised of a piezoelectric element 78, piezo housing 80, a push rod 82, and a push rod housing 84. More specifically, a piezo housing 80 is placed adjacent to a push rod housing 84 which abuts against the control valve seat 60. The piezoelectric element 78 is equipped with suitably insulated terminals 86 for the applying voltage thereto, an adjusting screw 88 for manually minimizing assembly lash, and appropriate upper and lower plates 90 and 92 for force transmission. The position of the peizoelectric element 78 is adjusted by way of the screw 88 to minimize the gap between the push rod 82 and the control valve 58. Another seal ring 94 may be positioned between the push rod 82 and the its housing 84 to prevent fuel from entering the piezo housing 80. In addition, a conical spring washer 96 may be positioned between the flange of the push rod 82 and the push rod housing 84 in order to pre-load the piezoelectric element 78.

In operation, high pressure fuel is delivered through the inlet port 34 from the common rail of the fuel delivery system (not shown). The fuel flow path proceeds through the fuel filter 32 to a point where the flow path is divided into two separate circuits. In the fuel delivery circuit, fuel flows through the annular passages surrounding the injector valve to the discharge opening in the valve seat 38. The passageways 26 and 28 are sized to produce a specific known pressure loss when the injector valve 16 is opened.

Figure 3:
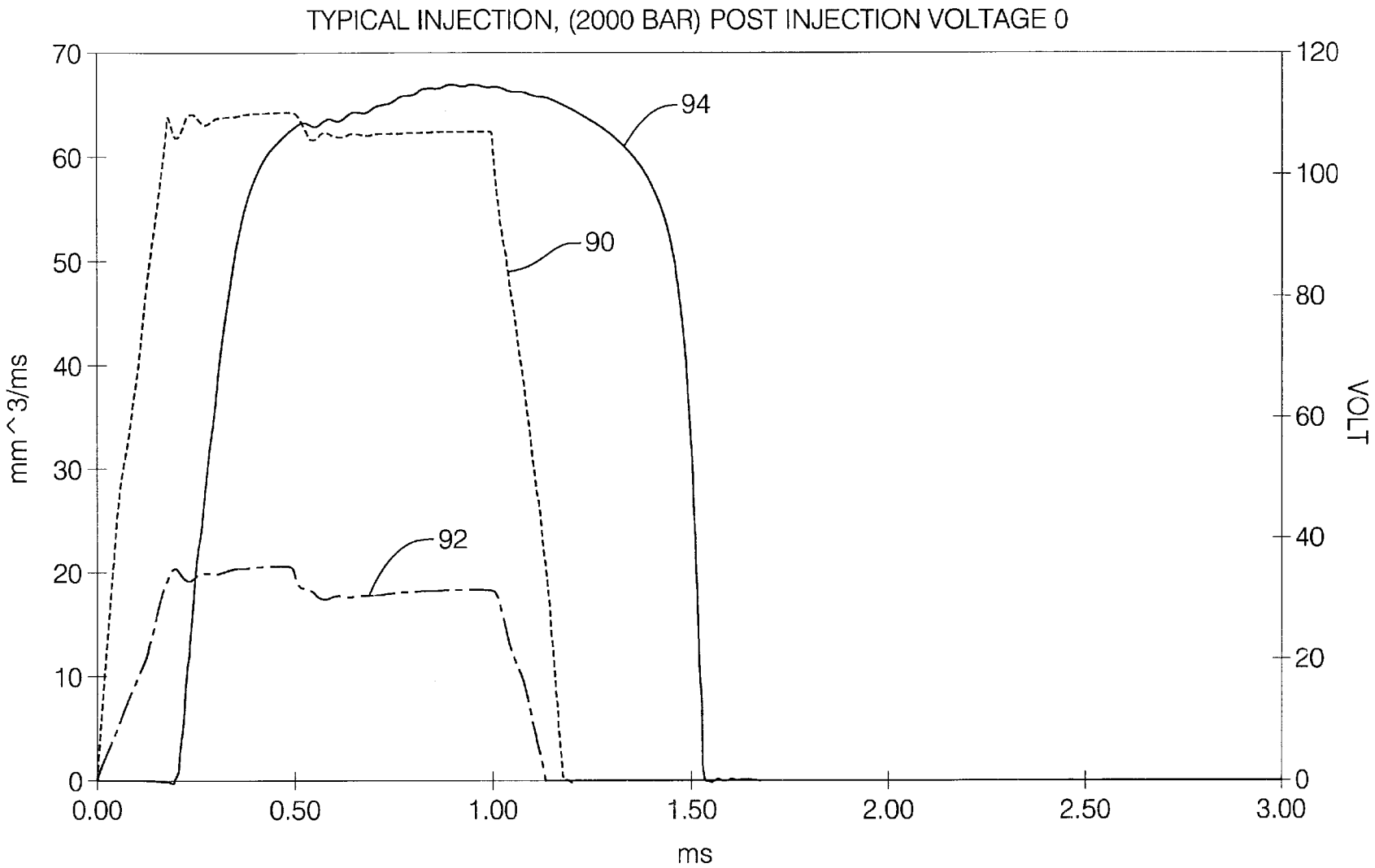
FIG. 3 is a chart illustrating a typical injection event in the piezoelectric actuated fuel injector.

In the control circuit, fuel flows though a drilled passage in the injector valve 16 through the control orifice 56 and into the control chamber 14. When the piezoelectric device 80 is not energized, the control valve 58 is held firmly in contact with the control valve seat 60 by the high pressure fuel, thereby preventing leakage to the fuel return port. When voltage is applied to the terminals, the piezoelectric device 80 expands longitudinally, thereby actuating the push rod 82 which in turn causes the control valve 58 to axially separate from the control valve seat 60. Thus, fuel escapes to the low pressure fuel return circuit. The resultant pressure drop causes the pressure in the control chamber 14 to be reduced such that the injector valve 16 axially separates from the valve seat 38 of the spray tip 36. Referring to FIG. 3, the voltage applied to the piezoelectric device ("piezo voltage") is shown at 90 for a typical injection event. The piezo voltage is charted against the fuel flow rate from the control chamber into the fuel return circuit shown at 92 and against the fuel flow rate from the injector ("rate of injection") shown at 94.

When the piezoelectric device 80 is deenergized, it contracts to its original length, thereby allowing the control valve 58 to reseal against the control valve seat 60. Thus, the pressure level in the control chamber 14 returns to the pressure level delivered to the fuel inlet port 38. Since the pressure at the spray tip end of the injector valve 16 is less than the pressure in the control chamber 14, the injector valve 16 is quickly closed.

Figure 4:
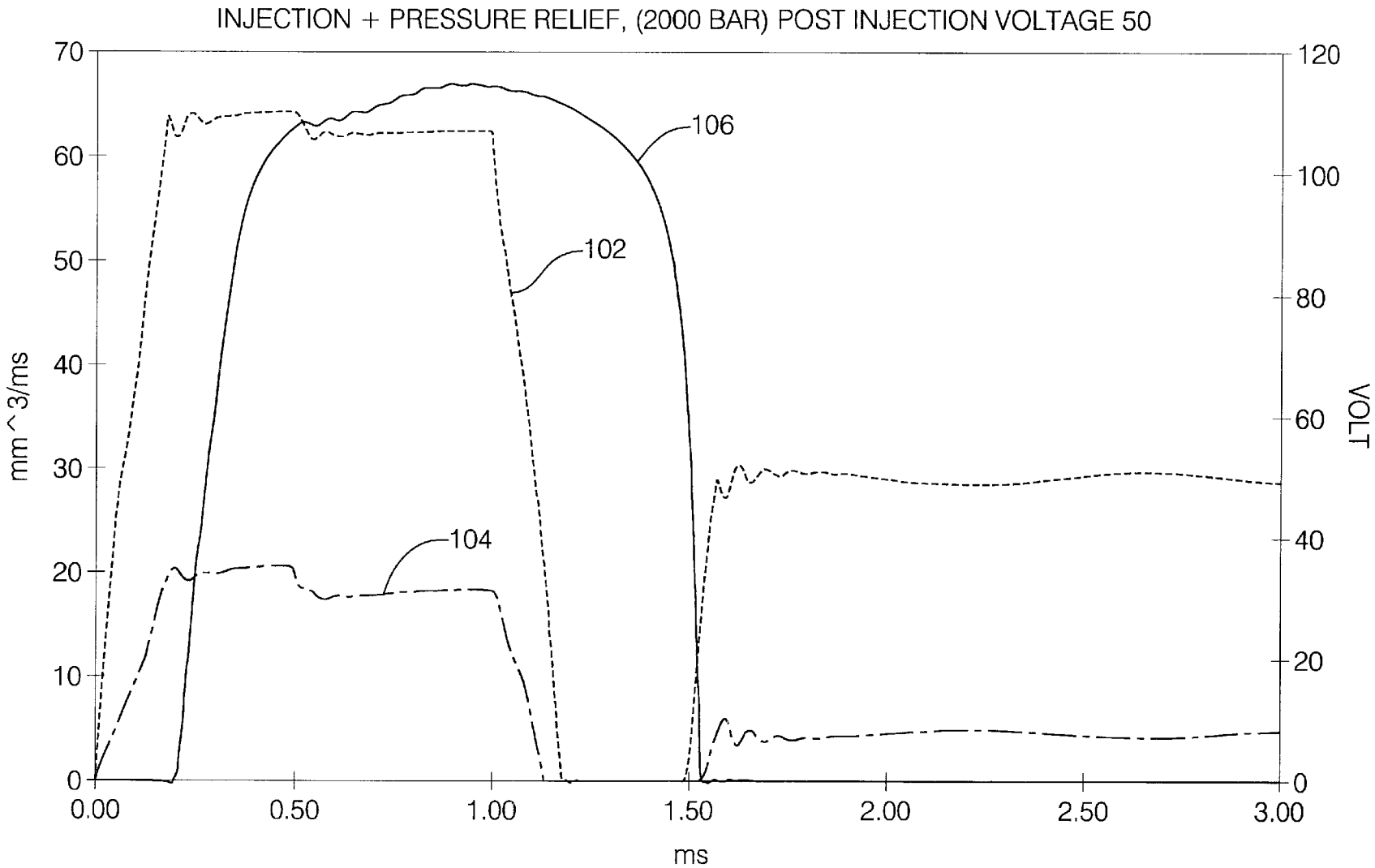
FIGS. 4 and 5 are charts illustrating how fuel pressure is relieved through the piezoelectric actuated fuel injector in accordance with the present invention.

In accordance with the present invention, a controller 21 as is known in the art is electrically connected to the terminals of the piezoelectric element 78 for supplying a drive voltage thereto. Again, the piezoelectric device 80 expands proportionally to the drive voltage that is applied to the device. Therefore, the control valve 58 is operable to axially separate from the control valve seat 60, such that the resultant pressure drop in the control chamber 14 does not cause the injector valve 16 to axially separate from the valve seat 38 of the spray tip 36. As shown in FIG. 4, the fuel pressure may be relieved through the fuel injector immediately following an injection event. To do so, the piezo voltage 102 is driven to a predetermined voltage level that allows a reduced fuel flow rate 104 through the control valve 58 to the fuel return circuit 19. It should be noted that the rate of injection 106 remains zero. Although the presently preferred timing is immediately following an injection event, it is envisioned that fuel pressure may also be relieved through this particular fuel injector at other times during the engine combustion cycle.

Figure 5:
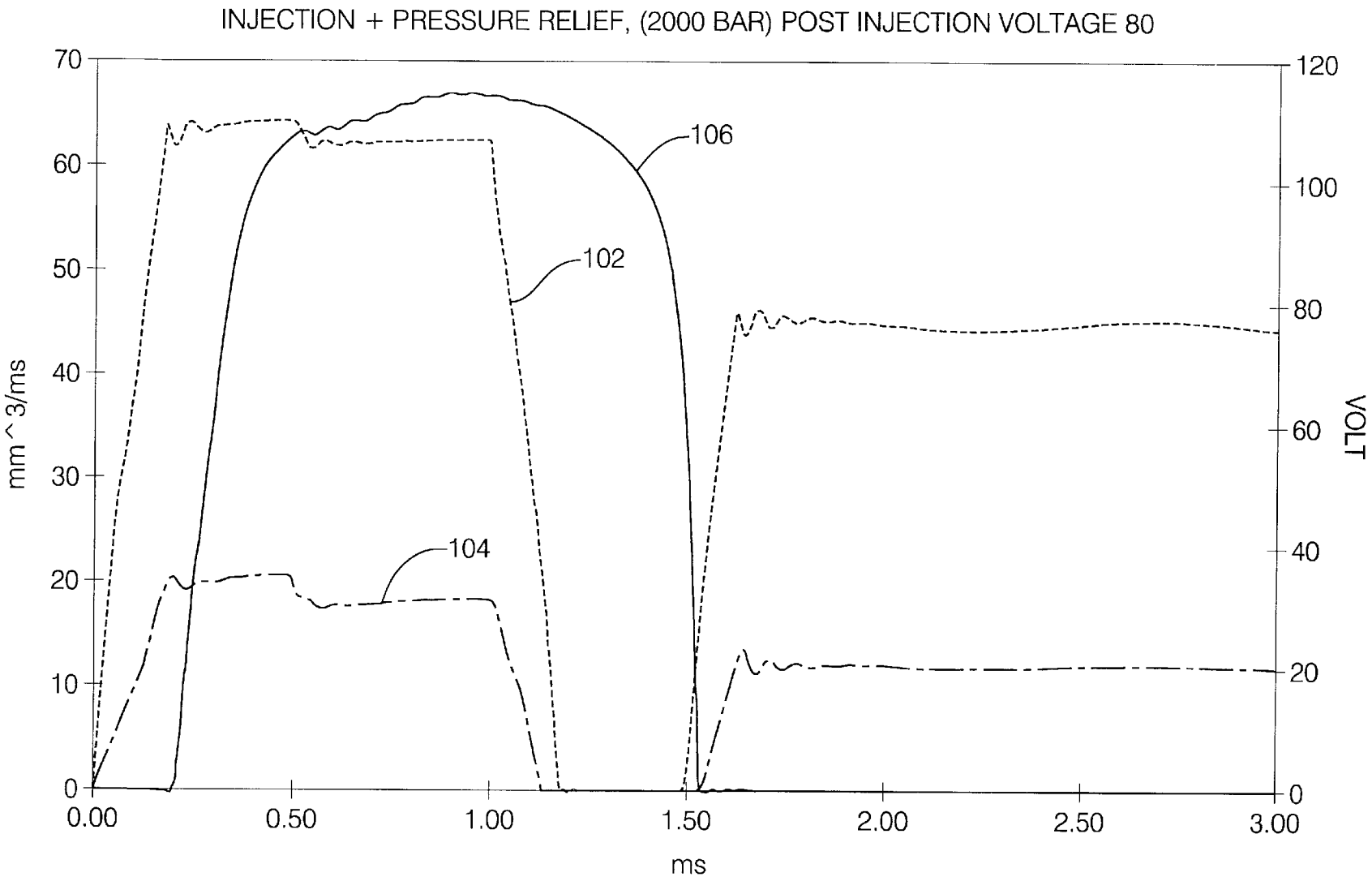

In FIG. 5, the piezo voltage 102 is driven to a higher voltage level, so that fuel flow rate 104 through the control valve is increased and yet the rate of injection 106 remains zero. Because the movement of the control valve is proportional to the longitudinal growth of the piezoelectric device, the present invention provides better control of the fuel pressure relieved through the low pressure return circuit. One skilled in the art will readily appreciate that the fuel pressure in the common rail can be controlled by the fuel flow rate through the control valve. It is further envisioned that fuel pressure may be controlled by relieving pressure through two or more of the fuel injectors (including some subcombination thereof) associated with the fuel injection system.

Figure 6:
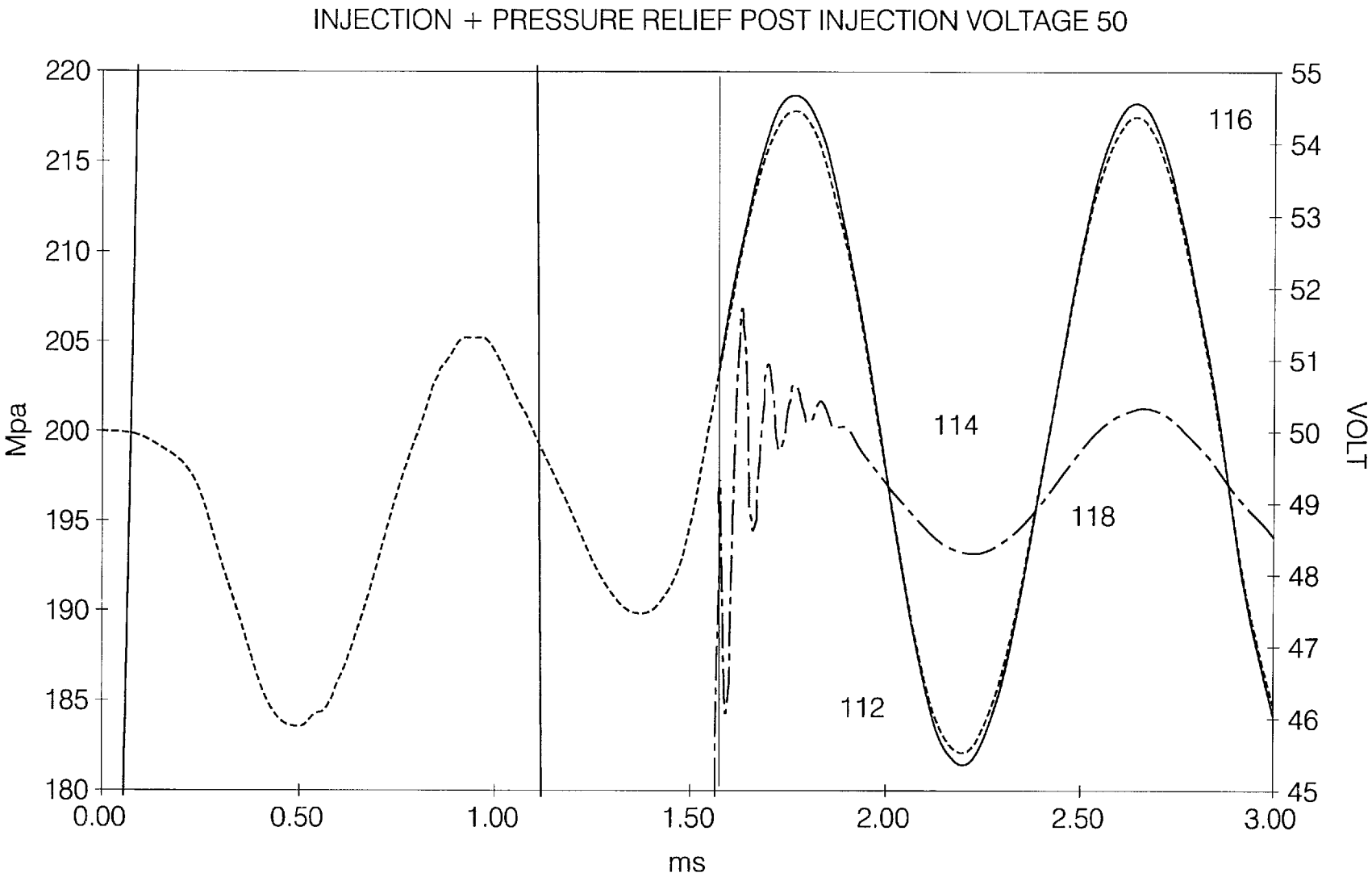
FIG. 6 is a chart illustrating how to compensate for pressure pulsations in the fuel injection system in accordance with the present invention.

Pressure pulsations can cause variations between fuel injection events as is well known in the fuel injection art. In another aspect of the present invention, the piezoelectric actuated fuel injector may be used to compensate for pressure pulses within the common rail of the fuel injection system. Due to the rapid dynamic response of the piezoelectric device, the fuel flow rate through the control valve can be adjusted or modulated to dampen pressure pulses in the fuel injection system as shown in FIG. 6. During a decrease in fuel pressure 112, the piezo voltage is decreased 114, thereby decreasing the fuel flow rate through the control valve. Likewise, during an increase in fuel pressure 116, the piezo voltage is increased 118, thereby increasing the fuel flow rate through the control valve. By using this drive scheme, one or more of the piezoelectric actuated fuel injectors can be used to compensate for pressure pulses in the system. In the preferred embodiment, the pressure sensor is used to detect pressure pulses in the common rail of the injection system.

In an alternative embodiment, the pressure sensor may be eliminated for purposes of this invention. In this case, a piezoelectric device may be used to detect pressure pulses in the system. Generally, when a mechanical load is applied to a piezoelectric device, it will generate an electric charge that is proportional to the mechanical load. Using this principle, one of the piezoelectric devices associated with the fuel injection system may be used to detect pressure pulses in the system. Additional discussion may be found in U.S. Provisional Patent Application Serial No. 60/182,090 entitled "A Drive Scheme To Use Piezoelectric Actuator As An Injection Event Sensor" and filed on Feb. 11, 2000 which is assigned to the assignee of the present invention and incorporated herein by reference. As will be apparent to one skilled in the art, the piezoelectric device in one of the fuel injectors is then used to detect pressure pulse whereas another fuel injector is used to relieve pressure to the fuel return circuit; otherwise the control scheme is as described above.

While the above description constitutes the preferred embodiment of the invention, it will be appreciated that the invention is susceptible to modification, variation, and change without departing from the proper scope or fair meaning of the accompanying claims.

What is claimed is:

1. A fuel injection system for controlling fuel pressure in a common rail through the use of a piezoelectric actuated fuel injector, comprising:

a fuel pump for supplying pressurized fuel;

a fuel injector having an axially extending fuel passage therein, said fuel injector further having a piezoelectric actuator, a control chamber in fluid communication with the fuel pump and with a low pressure fuel return circuit, an injector valve axially movable within the fuel passage in accordance with a fuel pressure in the control chamber, and a control valve for controlling the fuel pressure in said control chamber;

a pressure sensor for determining the fuel pressure in the system;

a controller electrically connected to the pressure sensor and to the piezoelectric actuator, the controller being operable to actuate the piezoelectric actuator, the piezoelectric actuator modulating the movement of the control valve without axially moving the injector valve within the fuel passage to control the fuel flow through the fuel injector and into the fuel return circuit and thereby dampen pressure pulses in the fuel injection system.

2. A fuel injection system for use in an internal combustion engine, comprising:

a fuel pump for supplying pressurized fuel;

at least two fuel injectors interconnected via a common rail to the fuel pump, where each fuel injector includes an injector valve axially movable in a fuel passage in accordance with a fuel pressure acting thereon, a control valve for controlling the fuel pressure acting on the injector valve, a piezoelectric actuator for actuating the control valve, the piezoelectric actuator modulating the movement of the control valve without axially moving the injector valve within the fuel passage, thereby dampening pressure pulses in the fuel injection system, and a control chamber for accumulating the fuel acting on the injector valve, the control chamber being in fluid communication with the fuel pump and a low pressure fuel return circuit; and a controller for actuating each of the piezoelectric actuators, thereby controlling fuel flow through each of the fuel injectors.

3. A fuel injection system for use in an internal combustion engine, comprising:

a fuel pump for supplying pressurized fuel;

at least two fuel injectors interconnected via a common rail to the fuel pump, where each fuel injector includes an injector valve axially movable in a fuel passage in accordance with a fuel pressure acting thereon, a control valve for controlling the fuel pressure acting on the injector valve, a piezoelectric actuator for actuating the control valve, and a control chamber for accumulating the fuel acting on the injector valve, the control chamber being in fluid communication with the fuel pump and a low pressure fuel return circuit; and a controller for actuating each of the piezoelectric actuators, thereby controlling fuel flow through each of the fuel injectors;

wherein one of the fuel injectors, in use, determines the fuel pressure in the system, and another of the fuel injectors, in use, relieves fuel pressure to the fuel return circuit.

4. The fuel injection system of claim 3 wherein the controller detects a change in a voltage associated with the piezoelectric actuator of one of the fuel injectors, where the change in voltage is in response to a change in the fuel pressure exerted on the injector valve.

5. A method for dampening pressure pulses in a fuel injection system through the use of a piezoelectric actuated fuel injector, comprising the steps of:

providing a fuel injector having an axially extending fuel passage therein, a control chamber in fluid communication with a low pressure fuel return circuit, an injector valve axially movable within the fuel passage in accordance with a fuel pressure in the control chamber, and a control valve for controlling the fuel pressure in said control chamber;

actuating the control valve using a piezoelectric actuator disposed in the fuel injector, such that the control valve is operable to selectively connect the control chamber to the fuel return circuit without axially moving the injector valve within the fuel passage, thereby reducing fuel pressure in the system;

detecting a pressure pulse in the system; and modulating the movement of the control valve in response to the pressure pulse, thereby adjusting the fuel flow rate to the fuel return circuit and dampening the pressure pulse in the fuel injection system.

6. The method for dampening pressure pulses of claim 5, wherein the step of modulating the movement of the control valve further comprises increasing the fuel flow rate to the return circuit in response to an increase in fuel pressure and decreasing the fuel flow rate to the fuel return circuit in response to a decrease in fuel pressure.

* * * * *